US011156017B1

(12) United States Patent
Zhang et al.

(10) Patent No.: US 11,156,017 B1
(45) Date of Patent: Oct. 26, 2021

(54) ROTATABLE BATTERY MOUNT FOR ELECTRONIC LOCKING DEVICES

(71) Applicant: Digilock Asia Ltd., Kowloon (HK)

(72) Inventors: An Zhang, Shaoguan (CN); Asil Gokcebay, Petaluma, CA (US)

(73) Assignee: Digilock Asia, Ltd., Kowloon (HK)

( * ) Notice: Subject to any disclaimer, the term of this patent is extended or adjusted under 35 U.S.C. 154(b) by 0 days.

(21) Appl. No.: 16/744,665

(22) Filed: Jan. 16, 2020

(51) Int. Cl.
*E05B 47/00* (2006.01)
*E05B 9/02* (2006.01)
*E05B 65/46* (2017.01)
*G07C 9/00* (2020.01)

(52) U.S. Cl.
CPC ..... *E05B 9/02* (2013.01); *E05B 47/00* (2013.01); *E05B 65/46* (2013.01); *G07C 9/00571* (2013.01); *E05B 2047/0058* (2013.01); *E05Y 2900/20* (2013.01); *E05Y 2900/208* (2013.01)

(58) Field of Classification Search
CPC . E05B 9/02; E05B 47/00; E05B 65/46; E05B 2047/0058; E05Y 2900/20; E05Y 2900/208; G07C 9/00571
USPC ..... 70/431, 278.1–278.5
See application file for complete search history.

(56) References Cited

U.S. PATENT DOCUMENTS 4,843,851 A * 7/1989 Frolov ..... E05B 47/0673 70/277
4,967,305 A * 10/1990 Murrer ..... E05B 47/068 340/5.54
5,894,277 A * 4/1999 Keskin ..... E05B 47/00 235/382
8,490,443 B2 * 7/2013 Gokcebay ..... G07C 9/00666 70/78
8,495,898 B2 7/2013 Gokcebay
8,833,118 B1 * 9/2014 McLane ..... E05C 1/08 70/85
9,208,628 B2 12/2015 Gokcebay
9,222,284 B2 12/2015 Gokcebay
9,273,492 B2 3/2016 Gokcebay
9,631,399 B1 4/2017 Zhang et al.
9,650,812 B2 * 5/2017 Denison ..... E05B 47/0012
10,161,165 B2 * 12/2018 Yuan ..... E05B 65/52
10,415,270 B2 * 9/2019 Lowe ..... E05B 47/0012
10,563,430 B2 * 2/2020 Hertrich ..... E05B 65/462
2005/0179517 A1 * 8/2005 Harms ..... G07F 5/22 340/5.9
2007/0209413 A1 * 9/2007 Dobbs ..... E05B 13/005 70/279.1
2009/0115196 A1 * 5/2009 Stango ..... E05B 13/101 292/61

(Continued)

*Primary Examiner* — Suzanne L Barrett
(74) *Attorney, Agent, or Firm* — Russell Petersen

(57) ABSTRACT

A rotatable battery mount includes a lock plate configured to be operatively coupled to a housing for an electronic locking device. The housing may be configured to mount to a panel or door of a cabinet or other article of furniture. A battery plate is pivotably coupled to the lock plate, and a battery case operatively coupled to the battery plate and configured to contain at least one battery for powering the electronic locking device. A hinge couples the lock plate and the battery plate, the hinge being configured to permit the battery plate to shift relative to the lock plate between a first position and a second position, the hinge configured to releasably secure the battery plate in at least the first position.

17 Claims, 12 Drawing Sheets

(56) References Cited

U.S. PATENT DOCUMENTS

| | | | | |
|---|---|---|---|---|
| 2014/0331723 | A1* | 11/2014 | Holz | E05B 65/44 70/278.1 |
| 2015/0279137 | A1* | 10/2015 | Bacon | E05B 81/66 70/278.1 |
| 2016/0017640 | A1* | 1/2016 | Soloway | G07C 9/00309 70/91 |
| 2017/0221291 | A1 | 8/2017 | Gokcebay | |
| 2018/0298642 | A1* | 10/2018 | Tagtow | E05B 63/0056 |
| 2019/0277062 | A1* | 9/2019 | Tagtow | G07C 9/00174 |

* cited by examiner

ROTATABLE BATTERY MOUNT FOR ELECTRONIC LOCKING DEVICES

FIELD OF THE DISCLOSURE

The present disclosure relates generally to the field of locks for mounting on doors or panels of cabinets, lockers, drawers, and of similar items of furniture. More particularly, a battery case for an electronically-operated lock may be separate from the lock housing and may be shifted between a first position, in which the battery case is easily accessible, to a second position, in which the battery case is stowed.

BACKGROUND

Metal and wood file cabinets, desk and cabinet drawers, locker doors, access panels and doors, mailboxes, dispensers and other selectively accessible container units often utilize lock mechanisms known as cam locks. In most examples, cam locks have a rotatable component at a back side. In one of the simplest forms, a cam lock on a cabinet door typically includes a cylinder fixed in a ¾ inch diameter D-shaped or double D-shaped opening and extending through the door. A cylinder plug is rotatably disposed within the cylinder, and at the back side of the cam lock cylinder, inside the cabinet, a metal blade or arm called a "cam" is connected to the plug. When the correct key is inserted into the cylinder plug and turned, the cylinder plug rotates the cam from a position disengaged from surrounding cabinet hardware to a position engaging a slot, ledge, or strike plate of the surrounding cabinet hardware, thereby locking the door closed. Such cam locks may or may not involve a camming action.

Other locks, such as those for desk drawers, commonly referred as cabinet locks, involve a camming type action as the key and plug are rotated, and these are also referred to as cam locks herein. The rotation causes a cam or nipple to move a deadbolt linearly to a locking or unlocking position, or in the case of a spring loaded latch or deadlatch, the rotation causes the cam or nipple to move a latch or deadlatch to unlocking position and removing the key keeps the latch or deadlatch in the extended locked position. In other examples, the plug moves other mechanisms that are engaged with the door or drawer of the cabinet or engages with other mechanisms that are linked to the door and drawer of the cabinet or multiple doors or drawers of the cabinet.

Metal filing cabinets often utilize cam locks, but sometimes have a variation known as a plunger type lock in which a spring-loaded plunger/lock cylinder located in the top horizontal margin of the cabinet, when pushed in, will lock all drawers. The use of a key releases the spring plunger to return to the outward position and unlock the drawers. These plunger locks are also referred to as cam locks herein, even though they have no rotatable member that locks and releases doors or drawers.

Locker, cabinet, and other furniture locks may include electronic locking devices. In these examples, the electronic device includes a housing containing electronics, and rather than a mechanical key, a user enters code. If the code is correct, the electronics of the electronic locking device can permit the user to rotate a knob, thereby rotating the plug within the cylinder unit, to unlock the locking device. Some exemplary electronic locking device use keypads, wireless communication methods such as RFID, Bluetooth, and NFC, non-volatile memory devices which work on contact such as IButtons, or other structure or methods, including a combination of the listed structure and methods, to control locking and unlocking. See, for example, U.S. Pat. No. 8,495,898 ("the '898 patent"), which is incorporated herein by reference in full.

Electronic locking devices such as these may be powered with a power supply such as one or more batteries, which may be housed in a battery case. As disclosed in the '898 patent referenced above and further disclosed in U.S. Pat. No. 9,208,628 ("the '628 patent") (which is also incorporated by reference in full), the battery case may be attached to or contained within the electronic locking device housing, or it may be separate from the electronic locking device housing but remain connected to the electronic locking device with a wire. In instances where the end user desires a small housing, that housing may not be large enough to contain the batteries necessary for the electronic locking device to operate. In other instances, wireless-based locks may require relatively large numbers of batteries. In those instances, the battery case may be separate from the housing and may be most desirably disposed in a location within an article of furniture that maximizes storage space within the furniture piece; that location, however, may not provide a user the optimum accessibility for the battery case when it becomes necessary to replace the lock's batteries. See, e.g., FIGS. 10-12 of the '628 patent.

There exists a need for a power supply of an electronic locking device to be concealable for normal operation, but to also be easily accessible when access to the power supply is necessitated, such as to change out spent batteries.

DETAILED DESCRIPTION

Reference will now be made in detail to examples of electronic locking devices and mounting these devices, examples of which are disclosed in the associated figures. Wherever possible, the same or corresponding parts will be referred to by the same or similar reference numbers across the drawings. Moreover, when more than one element of the same type is present, reference may be made either collectively or individually. Such reference is only exemplary, and, furthermore, reference to elements in the singular includes the plural and vice versa without limitation to the exact number or type of such elements.

Figure 1:
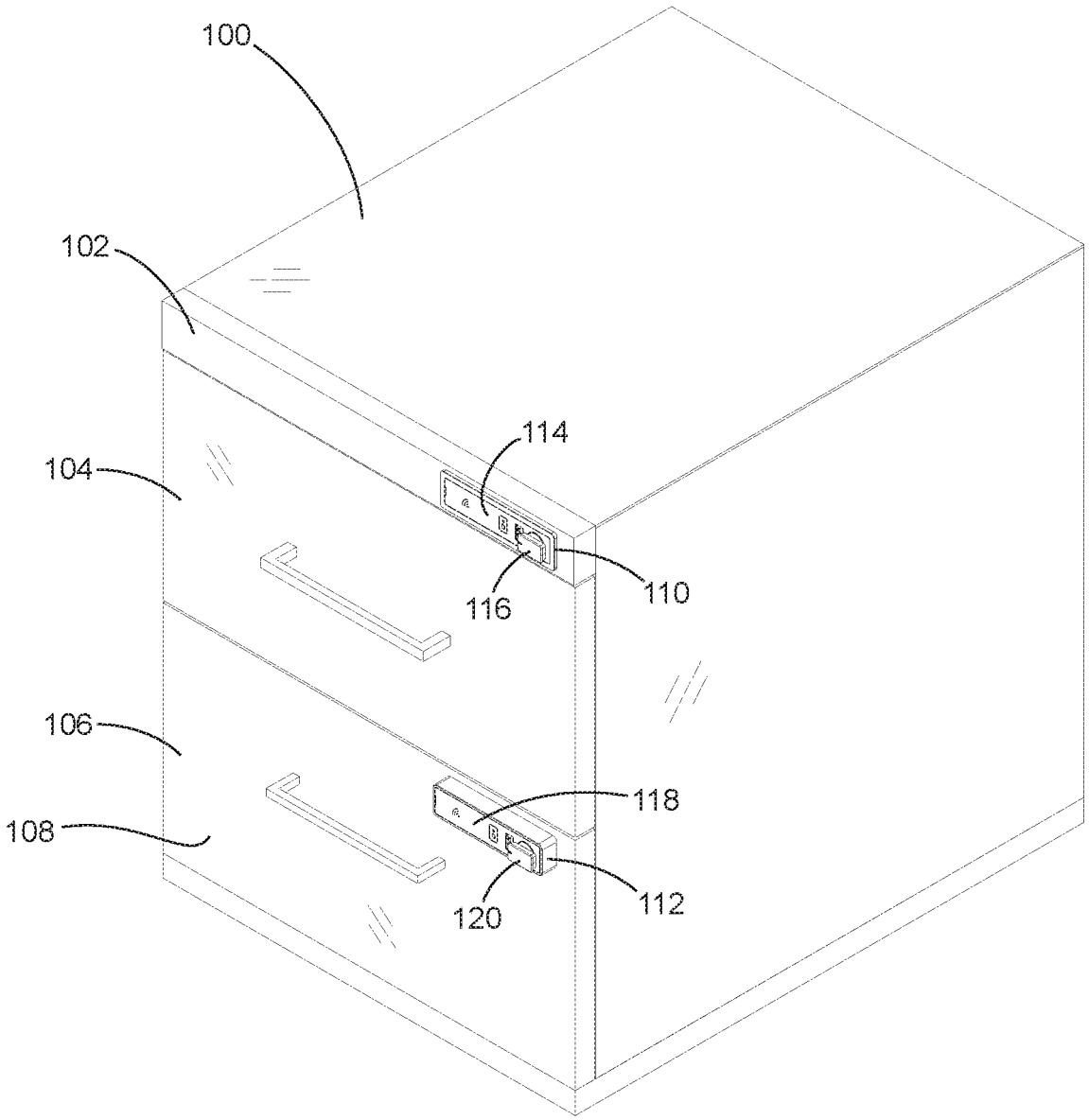
FIG. 1 is a perspective view of an exemplary filing cabinet including first and second exemplary electronic cam locks.

FIG. 1 discloses an example of a typical two-drawer file cabinet 100 having a top rail 102, an upper drawer 104, and a lower drawer 106, the file cabinet 100 defining a front surface 108 common to all of the top rail 102, the upper drawer 104, and lower drawer 106. Disposed in the top rail 102 is a first electronic lock device 110, and a second electronic locking device 112 is disposed on the front surface 108 of the lower drawer 106. As will be described further, the first electronic lock device 110 in this example is a cam lock of known construction that can lock and unlock the upper drawer 104, and, in some embodiments, is able to lock and unlock the lower drawer 106. In the example disclosed herein, the first lock 110 only addresses the upper drawer 104, and the second electronic lock device 112 can lock and unlock the lower drawer 106.

The first lock 110 is recess-mounted in the top rail 102 of the file cabinet 100 above the upper drawer 102 such that only a front face 114 and a rotatable knob 116 are visible and accessible to the user. The second electronic lock device 112 in this example is also a cam lock of known construction that is mounted on the front surface 108 of the lower drawer 106, and so a housing 118 and rotatable knob 120 of the second lock 112 are accessible to the user.

Figure 2A:
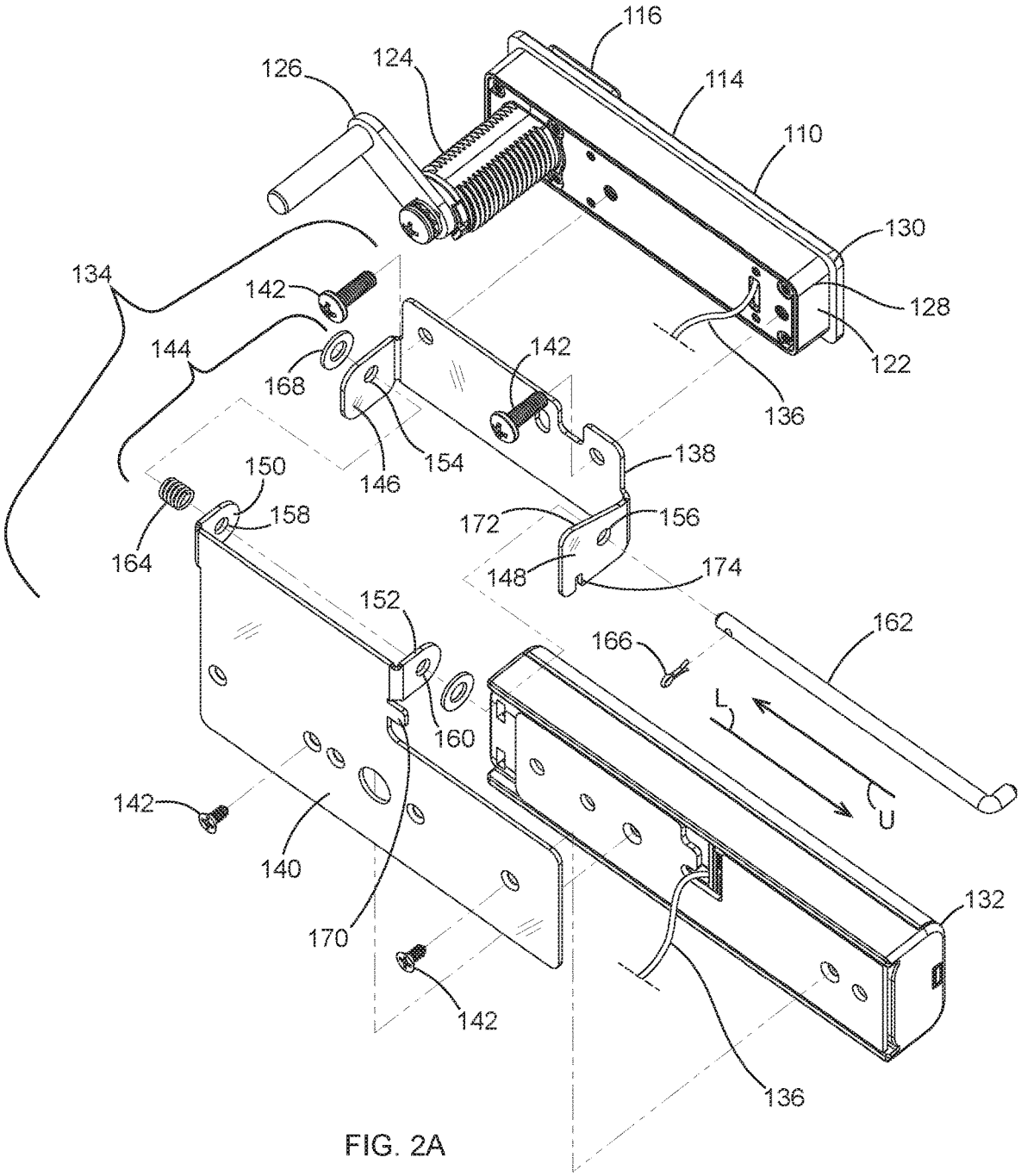
FIG. 2A is an exploded perspective view of the first exemplary electronic cam lock of FIG. 1.

Referring now to FIG. 2A, the first lock 110 is shown in greater detail. The first lock 110 can be of known construction, having a housing 122, a threaded cylinder 124 extending rearwardly from the housing 122, a rotatable core disposed within the threaded cylinder 124 and operatively coupled to the knob 116, and a rotatable locking element 126 operatively coupled to the rotatable core, such that rotation of the knob 116 will rotate the core and the locking element 126. In this example, with the first lock 110 being designed to be recess mounted, the housing 122 includes a main body 128 and a peripheral rim 130 extending out from the main body 128. Further, the locking element 126 is of the type that can raise and lower a rod (not shown) for simultaneously locking or unlocking a series of file cabinet drawers. As will be discussed later, the second lock 112 can be of similar construction to the first lock 110 with only slight variations.

The first and second locks 110, 112 may be operated in a known manner through input of an electronic credential or other access code via a terminal, such as by inputting a PIN into a keypad, reading an ID such as a barcode or QR scanner, communicating credentials through wireless communication (e.g., an RFID, NFC, or Bluetooth device), identifying biometric information, or using any other data input method known in the art or any combination therein. As is further known, a microcontroller will analyze the access code, and upon a proper access code being entered, the locks 110, 112 will permit manual rotation of the respective rotatable knob or lever 116, 120, thereby allowing rotation of the locking element 126 from a locked position to an unlocked position. This rotation will allow opening of the drawer or panel. Other locking mechanisms known in the art may also be used, such as a cam, a latch, or a bolt. Although the term microcontroller is used herein, it will be understood by one of ordinary skill that any number of structures can be used to effectuate the functions described herein, e.g. controllers, processors, microprocessors, and addressable switches, and therefore the term microcontroller as used herein shall be understood to encompass all such structures.

As seen in FIGS. 2A-2E, the first lock 110 may include a battery case 132 separate from the housing 122 and a rotatable mount 134 connecting the housing 122 to the battery case 132. The battery case 132 is electrically connected to the housing 122 by a wire 136 to supply power to the housing 122.

The battery mount 134 includes a lock plate 138 for mounting to the housing 122 and a battery plate 140 for mounting to the battery case 132. In this embodiment, both the battery case 132 and the housing 122 are mounted to the rotatable battery mount 134 using fasteners 142. The lock plate 138 and the battery plate 140 are integral with, and jointly define, at least in part, a hinge 144 such that the battery plate 140—and thus the battery case 132—may be pivoted relative to the lock plate 138. In particular, in this example, the lock plate 138 and the battery plate 140 comprise and are integral to a first leaf and a second leaf of the hinge 144 itself. In other examples, the lock plate 138 and the battery plate 140 are connected to the hinge 144.

The hinge 144 includes first and second knuckles 146, 148 extending laterally out from the lock plate 138, and third and fourth knuckles 150, 152 extending laterally out from the battery plate 140. Disposed within each knuckle 146, 148, 150, 152 is a respective opening 154, 156, 158, 160, each of which is coaxial. The hinge 144 further includes a pin 162 disposed through each knuckle 146, 148, 150, 152 and defining an axis of rotation between the battery plate 140 and lock plate 138.

The distance between first and second knuckles 146, 148 is greater than the distance between third and fourth knuckles 150, 152, and as such, the third and fourth knuckles 150, 152 fit in between the first and second knuckles 146, 148, and, moreover, the battery plate 140 can slide laterally a short distance along the pin 162 in directions U and L. The hinge 144 further includes compression spring 164 disposed between the first and third knuckles 146, 150 such that the battery plate 140 is biased in direction L. Finally, a cotter pin 166 is disposed in the pin 162 and a washer 168 is disposed on the outside of the first knuckle 146 such that the cotter pin 166 bears against the washer 168, which bears against the outside of the first knuckle 146, and thereby prevents the pin 162 from sliding out of the hinge 144 in direction L.

Figure 2B:
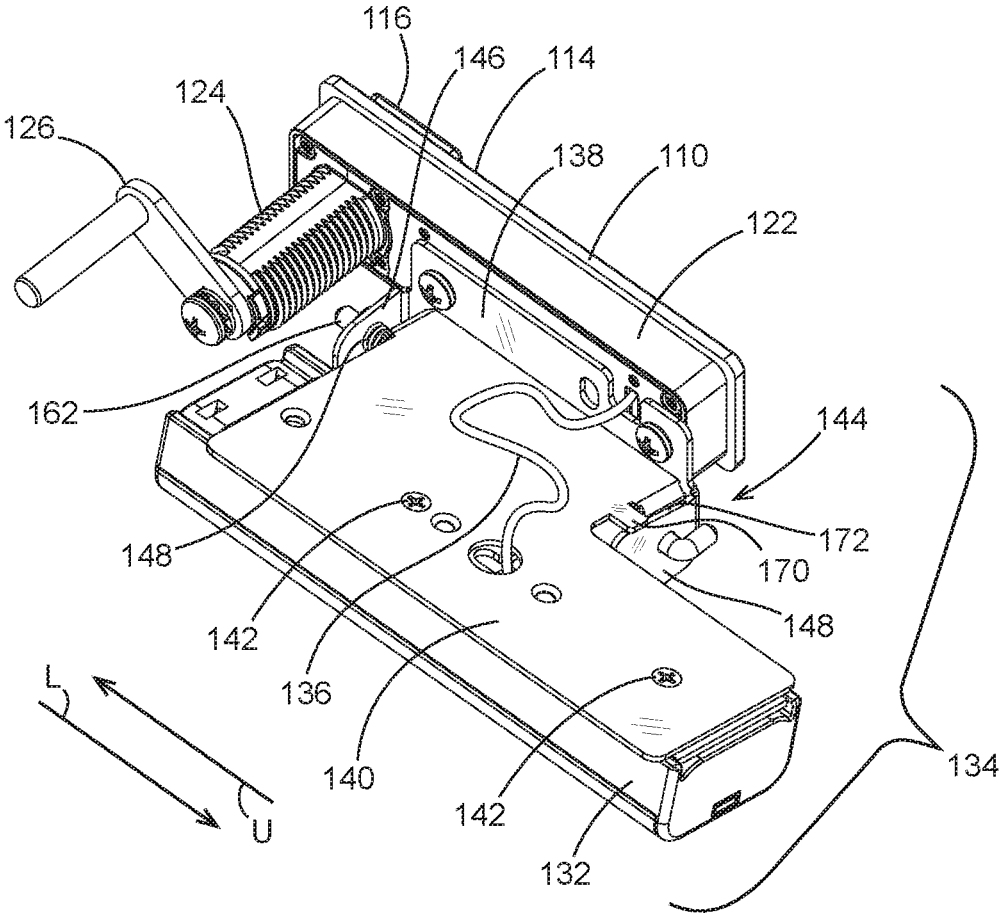
FIG. 2B is a perspective view of the electronic cam lock of FIG. 2A with the battery mount in a first fixed position.

The first lock 110 further includes structure to selectively fix the battery plate 140 in either a first position or a second position. The battery plate 140 includes a lock tab 170. While the battery plate 140 is in the first position as shown in FIG. 2B, the lock tab 170 bears on a top edge 172 of the second knuckle 148 of the lock plate 138, thereby maintaining the battery plate 140 in the first fixed position and preventing the battery plate 140 from rotating downwardly. This first fixed position is the position typically maintained during day-to-day usage of the first lock 110, with the battery plate 140 and battery case 132 held in a position that does not interfere with usage of the upper drawer 104.

Figure 2C:
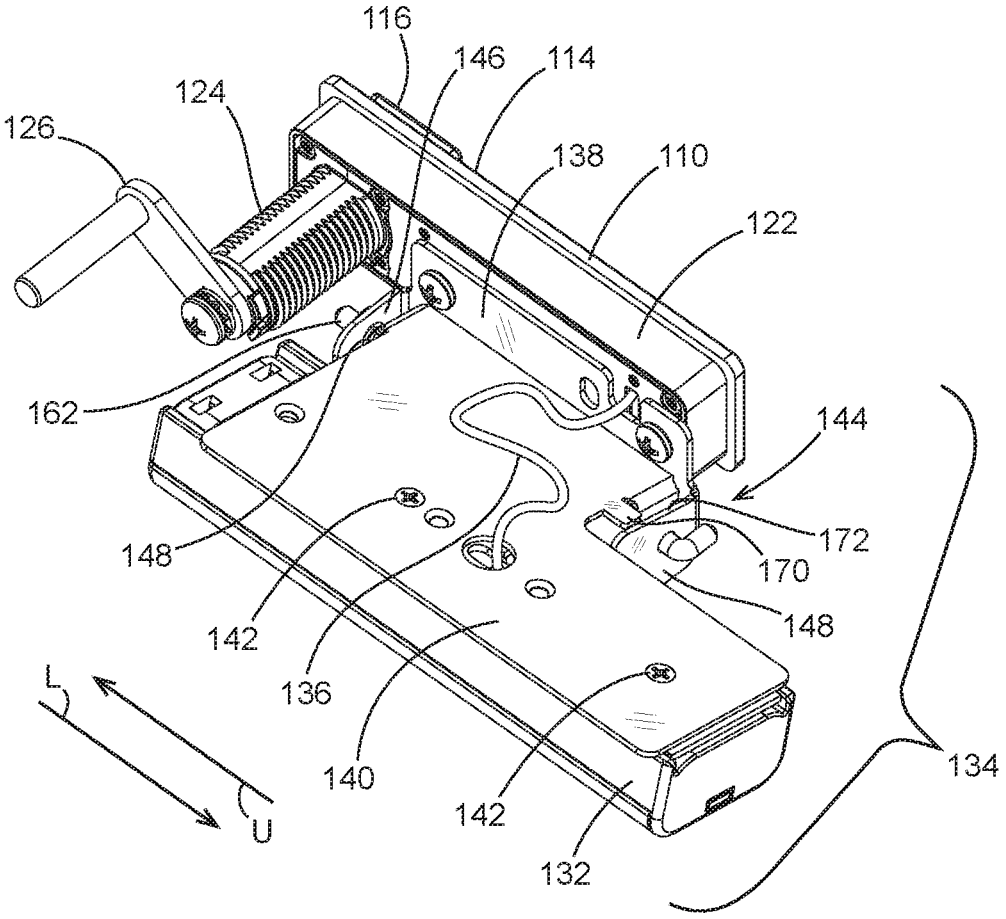
FIG. 2C is a perspective view of the electronic cam lock of FIG. 2A with the battery mount in a first intermediate position.
Figure 2D:
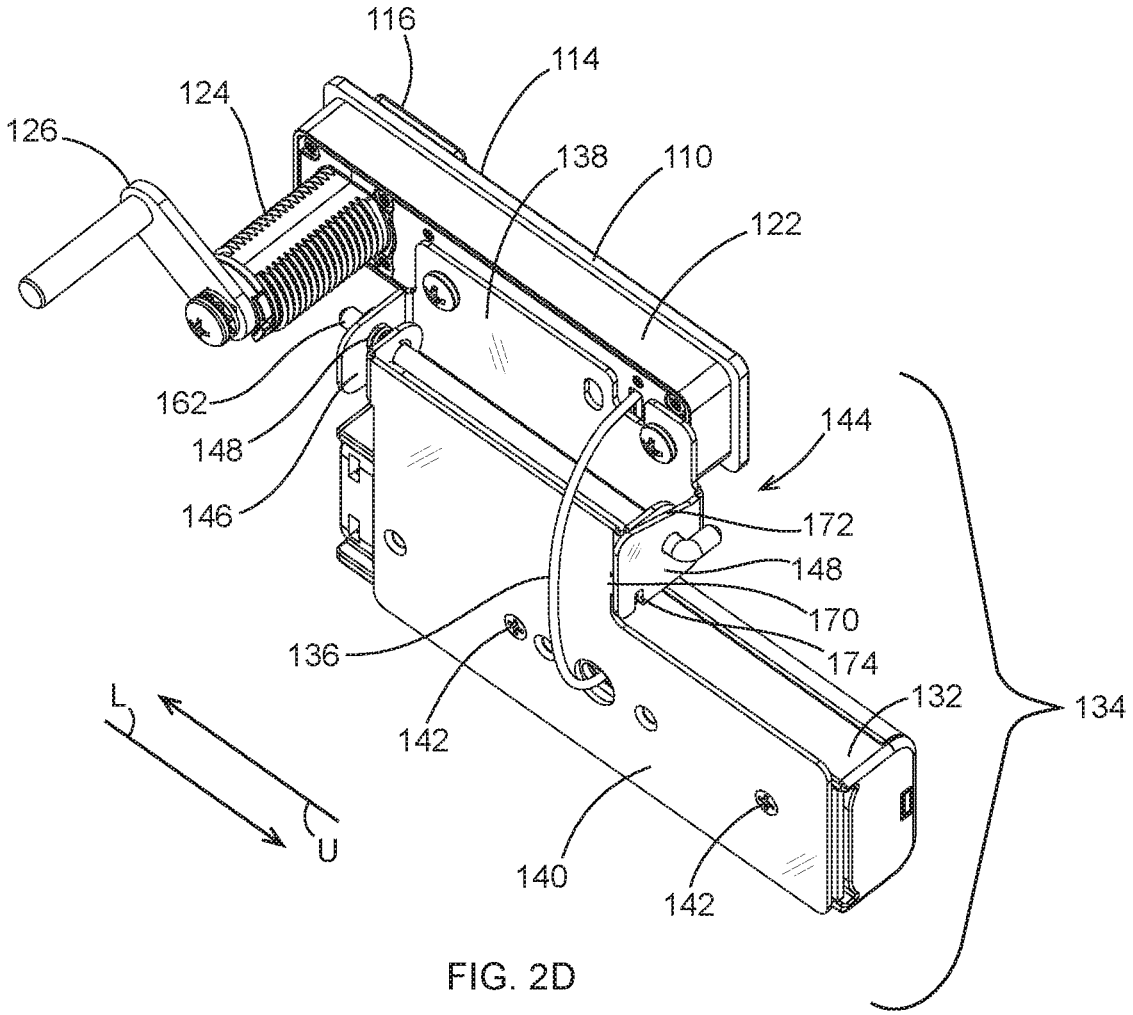
FIG. 2D is a perspective view of the electronic cam lock of FIG. 2A with the battery mount in a second intermediate position.

To enable the battery plate 140 to rotate downward, a user may first slide the battery plate 140 horizontally along the pin 162 in direction U, from the first fixed position as shown in FIG. 2B to a first intermediate position shown in FIG. 2C, by manually pushing the battery plate 140 horizontally against the biasing force of the compression spring 164. Upon reaching the position shown in FIG. 2C, the lock tab 170 no longer bears on the top edge 172 of the second knuckle 148 of the lock plate 138.

Figure 2E:
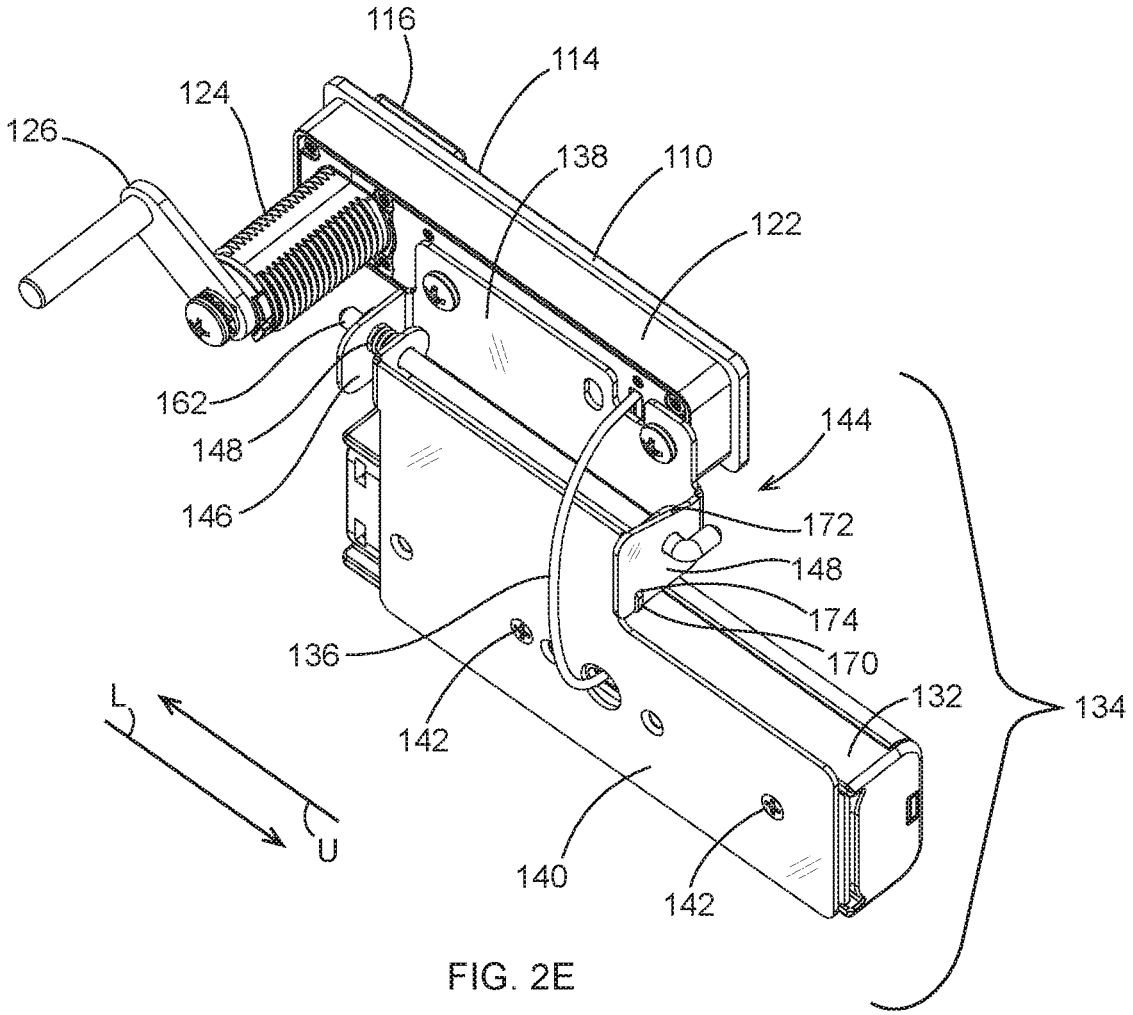
FIG. 2E is a perspective view of the electronic cam lock of FIG. 2A with the battery mount in a second fixed position.

In the position shown in FIG. 2C, the lock tab 170 is free of the top edge 172, and the battery plate 140 is able to be rotated downward such as through gravity or manual rotation by the user. Thus, from the first intermediate position shown in FIG. 2C, the battery plate 140 may be rotated downward to a second intermediate position shown in FIG. 2D. At the position shown in FIG. 2D, the user can release the battery plate 140, and the compression spring 164 biases the battery plate 140 horizontally in direction L along the pin 162 towards the second fixed position shown in FIG. 2E. As the battery plate slides in the second position, the lock tab 170 lodges into a recess 174 in the lock plate 138, thereby fixing the battery plate 140 in the second fixed position as shown in FIG. 2E and preventing the battery plate 140 from being rotating in either direction. In the second fixed position, the battery case 132 is accessible to the user, and the user may open the case to remove any expired batteries and replace them with fresh batteries.

The user may return the battery plate 140 from the second fixed position shown in FIG. 2E to the first fixed position shown in FIG. 2B simply by reversing the steps described above, as will be clear to one of skill in the art. A user may first slide the battery plate 140 horizontally along the pin 162 in direction U from the second fixed position shown in FIG. 2E to the second intermediate position shown in FIG. 2D by manually pushing the battery plate 140 horizontally against the biasing force of the compression spring 164. Once reaching the position shown in FIG. 2D, the lock tab 170 is removed from the recess 174 of the lock plate 138, thereby enabling the battery plate 140 to rotate upward, such as to the first intermediate position shown in FIG. 2C. Once rotated to the position shown in FIG. 2C, the biasing force of the compression spring 164 biases the battery plate 140 horizontally along the pin 162 in direction L towards the first fixed position shown in FIG. 2B. Once the battery plate 140 is in the position shown in FIG. 2B, the lock tab 170 once again bears on the top edge 172 of the second knuckle 148, thereby once again affixing the battery plate 140 in the first fixed position as shown in FIG. 2B.

Figure 3A:
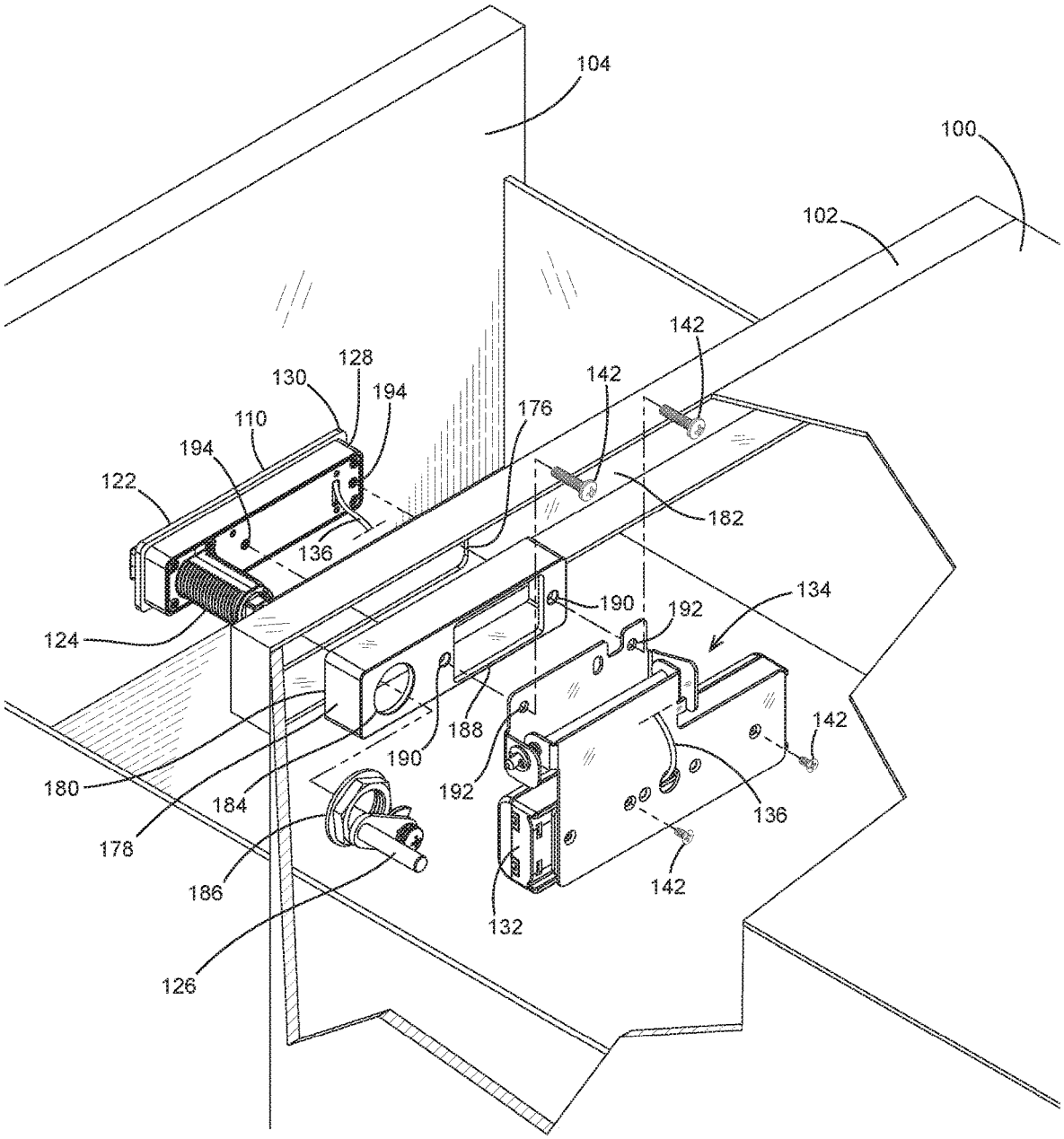
FIG. 3A is an exploded perspective view of the upper drawer of the file cabinet of FIG. 1, in a partial cut-away with the upper drawer open, in particular showing the electronic cam lock of FIG. 2A.
Figure 3B:
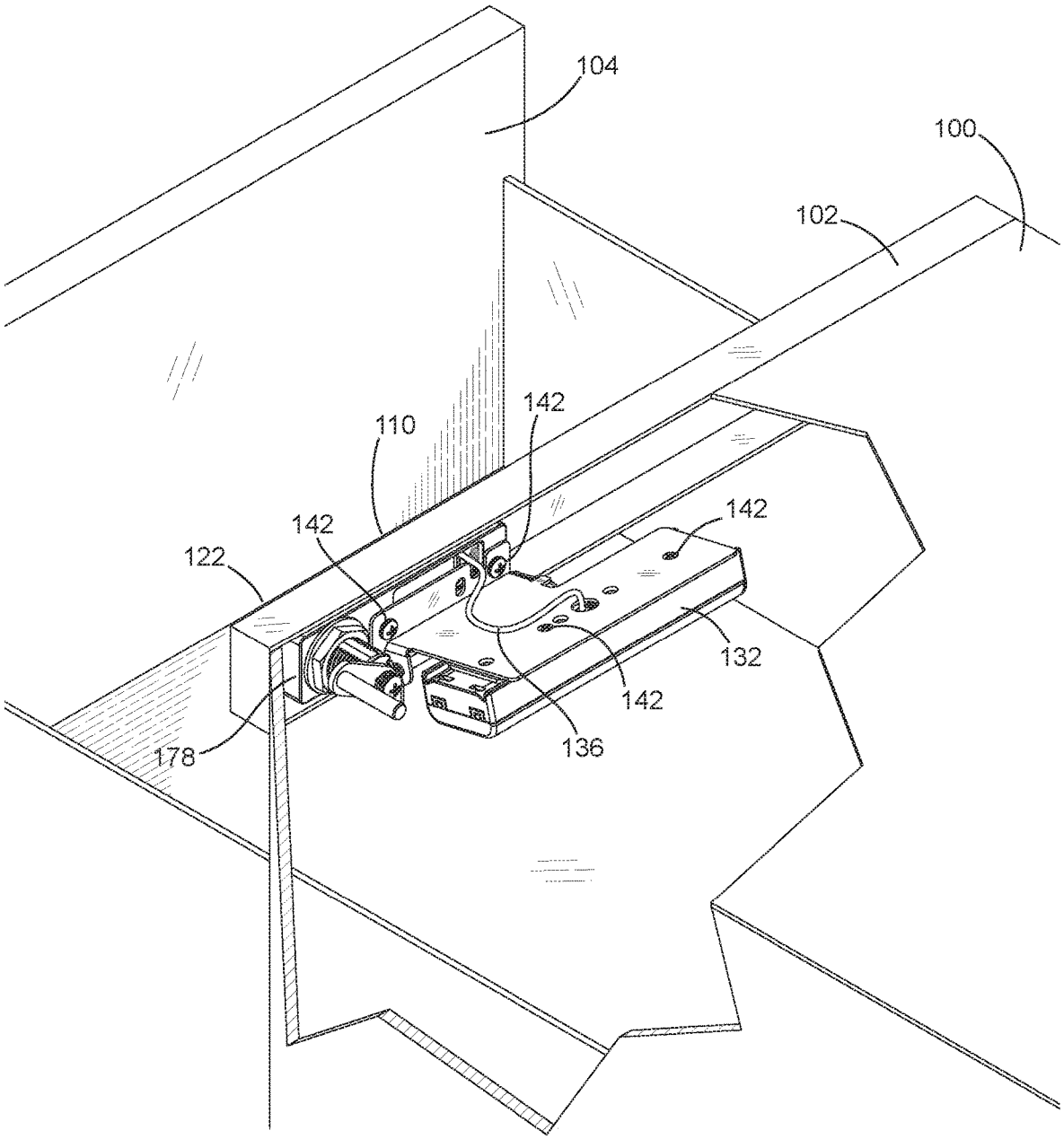
FIG. 3B is a perspective view of the upper drawer of the file cabinet of FIG. 3A with the battery mount in a first fixed position.

As shown in FIGS. 3A-3B the first lock 110 can be installed in the top rail 102 of the file cabinet 100. The top rail 102 includes an opening 176 sized and shaped to allow passage of the main body 128 through the top rail 102, while the peripheral rim 130 bears against the front surface 108 of the top rail 102 when mounted.

Affixed within the top rail 102 is a casing 178 sized and shaped to receive the main body 128. The casing 178 includes a front edge 180 that bears against an internal surface 182 of the top rail 102 such that the peripheral rim 130 and the front edge 180 sandwich the front surface 108 and internal surface 182 of the top rail 102.

The casing 178 includes a first clearance hole 184 that allows the threaded cylinder 124 to pass therethrough. A nut 186 can be threaded onto the cylinder 124 and against the casing 178 to help secure the housing 122 and force the front edge 180 of the casing 178 against the top rail 102. The casing 178 also includes a second clearance hole 188 that allows the wire 136 to pass from the housing 122 to the battery case 132.

The casing 178 further includes two fastener through holes 190 which are coaxial with first and second through holes 192 of the locking plate 138, and which are further coaxial with two internally threaded holes 194 in the housing 122. Fasteners 142 are used to affix the lock plate 138 and the casing 178 to the housing 122 via these aforementioned through holes 190, 192 and threaded holes 194.

Figure 3C:
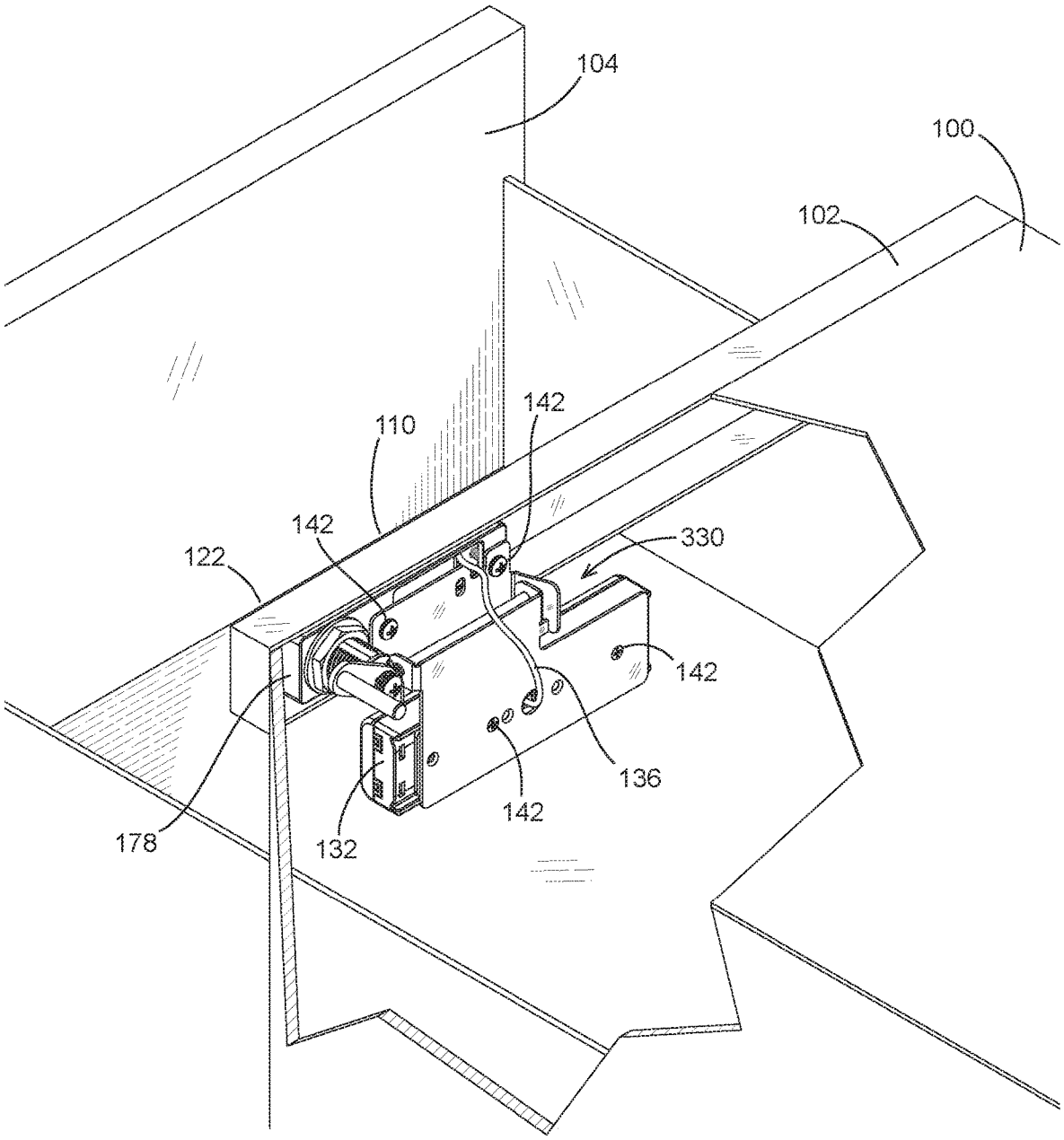
FIG. 3C is a perspective view of the upper drawer of the file cabinet of FIG. 3A with the battery mount in a second fixed position.

The first position of the rotatable battery mount 134 in this embodiment as shown in FIG. 3B allows the battery case 132 to remain concealed during normal use and corresponds to the first fixed position shown in FIG. 2B, whereas the second position as shown in FIG. 3C corresponds to the second fixed position shown in FIG. 2E and allows a user to more easily access the battery case 132, such as to change out spent batteries. The battery case 132 may include a snap-fit cover or a cover that is fastened using screws as is known in the art. Furthermore, to rotate the rotatable battery mount 134 between the first fixed position and the second fixed position using the steps described above, a user may simply open the upper drawer 104 and reach behind the top rail 102 to perform the rotation and shift the battery case 132 into a very accessible location.

Figure 4A:
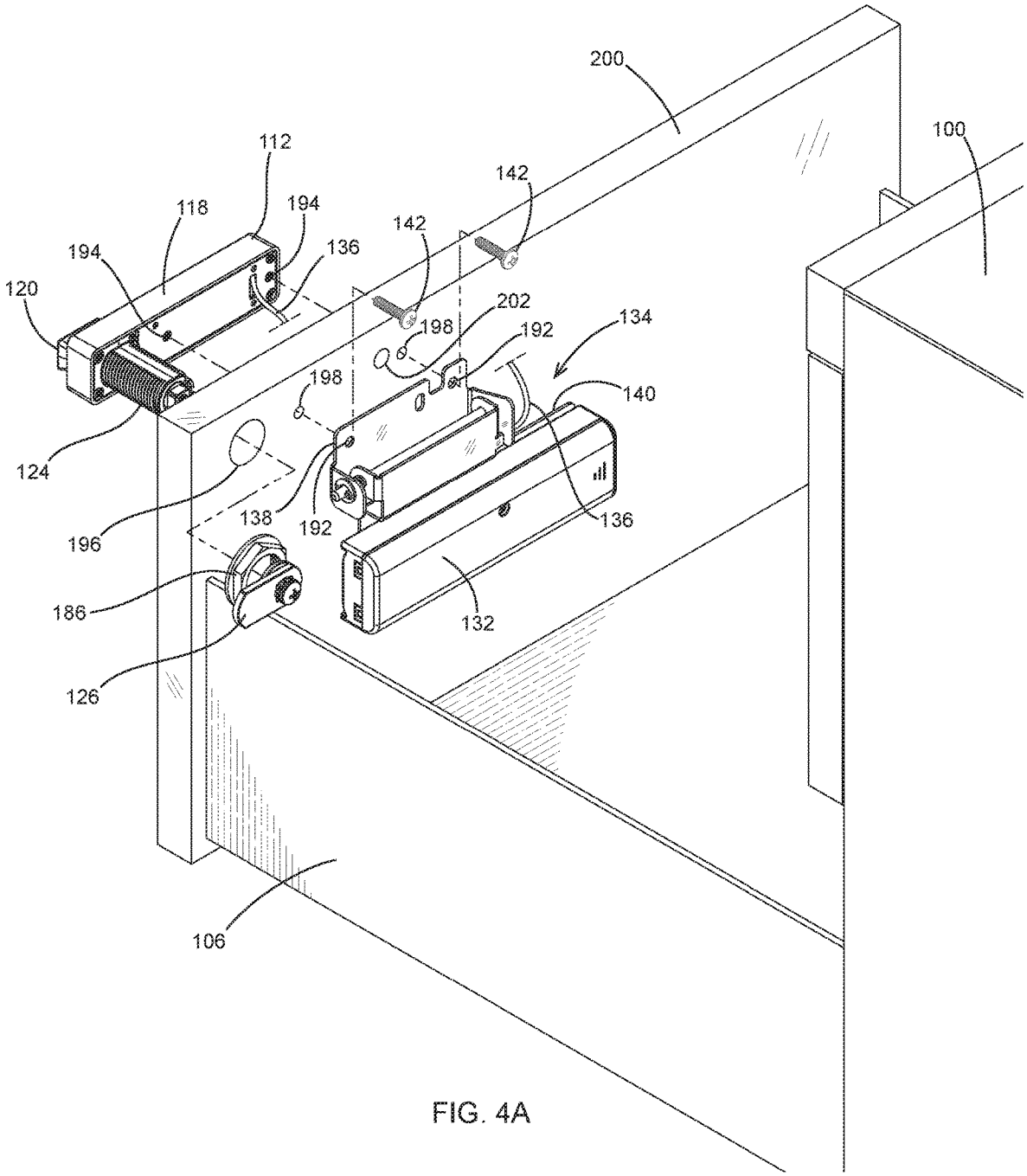
FIG. 4A is an exploded perspective view of the bottom drawer of the file cabinet of FIG. 1 with the bottom drawer open, in particular showing the second exemplary electronic cam lock of FIG. 1.

FIG. 4A shows in detail the installation of the second lock 112 to the lower drawer 106 of the file cabinet 100. As mentioned above, the lower drawer 106 does not include an opening for recess-mounting. Rather, the housing 118 of the second lock 112 is mounted to the front surface 108 of the lower drawer 106, and the lower drawer includes a first clearance holes 196 to allow passage of the threaded cylinder 124 and second clearance holes 198 for mounting purposes through a front panel 200 of the lower drawer 106. Moreover, the front panel 200 includes a wiring opening 202 to allow passage of the wire 136 from the battery case 132 to the housing 118.

Figure 4B:
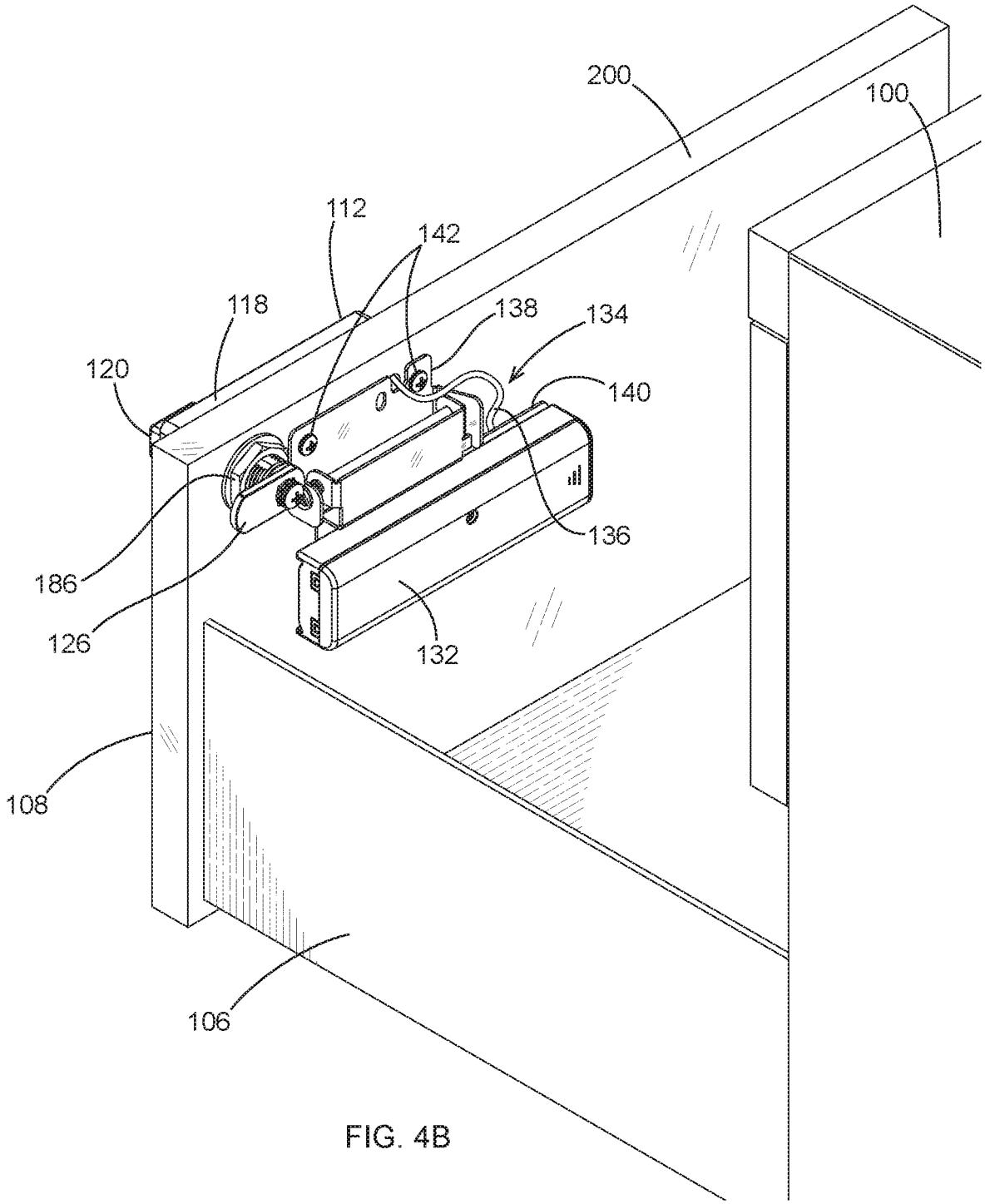
FIG. 4B is a perspective view of the bottom drawer of the file cabinet of FIG. 4A with the battery mount in a first fixed position.
Figure 4C:
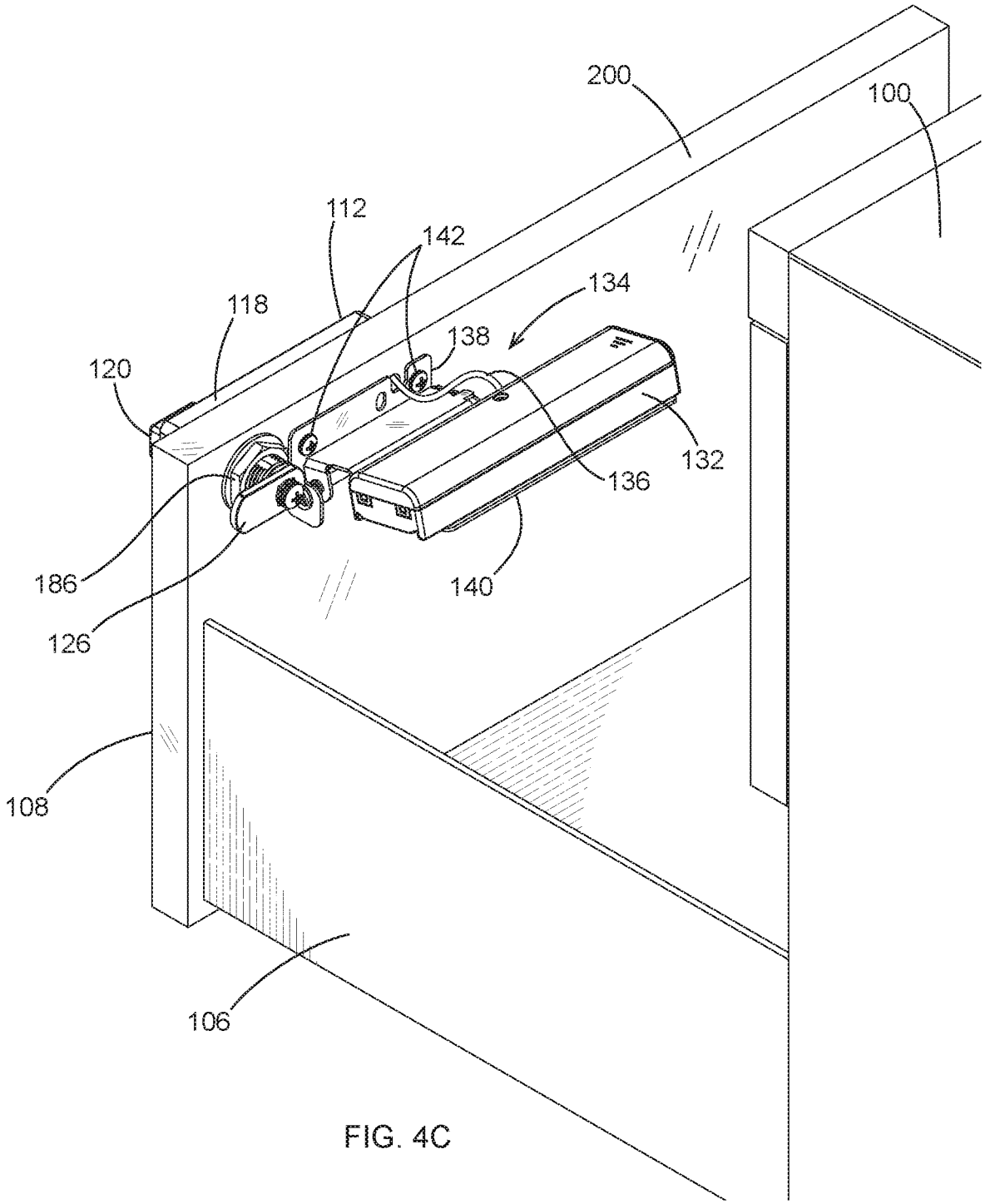
FIG. 4C is a perspective view of the bottom drawer of the file cabinet of FIG. 4A with the battery mount in a second fixed position.

The clearance holes 198 of the front panel 200 additionally allow the rotatable battery mount 134 to be mounted to the rear of the front panel 200. Thus, the front panel 200 is sandwiched between the housing 118 and the rotatable battery mount 134, thereby firmly holding the second lock 112 in place. In this embodiment, the second fixed position of the rotatable battery mount 134 is shown in FIG. 4B, which allows the battery case 132 to remain concealed during normal use. In FIG. 4C, the battery case 132 is shown in the first fixed position, which allows a user to access the battery case 132, such as to change out spent batteries. Furthermore, to rotate the rotatable battery mount 134 between the first and second fixed positions the rotation steps described above, a user may simply to open the lower drawer 106 and reach behind the front panel 200 to perform the rotation.

The examples disclosed herein describe a battery compartment that is pivotable between two positions relative to the housing and has structure that maintains the battery case selectively in at least one of those two positions to allow for improved use of the furniture and ease of accessibility of the battery compartment. Based on the teachings of this disclosure, one of ordinary skill may recognize other structures that perform similar functions. These structures may include, for example, locking hinges, bi-stable springs, latches, magnets, bolts, clamps, straps, interacting teeth, frictional mounts, or other releasable mechanical or electromechanical fasteners or combinations of releasable fasteners.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

The invention claimed is:

1. A rotatable battery mount, comprising:

a lock plate configured to be operatively coupled to a housing for an electronic locking device;

a battery plate pivotably coupled to the lock plate;

a battery case operatively coupled to the battery plate and configured to contain at least one battery for powering the electronic locking device; and a hinge operatively coupling the lock plate and the battery case, the hinge being configured to permit the battery case to pivot relative to the lock plate between a first position and a second position, the hinge configured to releasably secure the battery case in at least the first position.

2. The rotatable battery mount of claim 1, the hinge comprising a pin defining an axis about which the lock plate and battery case pivot.

3. The rotatable battery mount of claim 2, the lock plate and the battery case configured to shift in a direction parallel to the axis to release the battery case from the first position.

4. The rotatable battery mount of claim 2, further comprising a tab and a recess, the tab configured to seat in the recess to releasably secure the battery plate.

5. The rotatable battery mount of claim 1, wherein the lock plate and battery plate are integral with the hinge.

6. The rotatable battery mount of claim 1, wherein the battery case is releasably secured in the first position by at least a portion of the lock plate contacting at least a portion of the battery plate.

7. An electronic locking device, comprising:

a housing having a terminal for the receipt of an access code, a microcontroller in communication with the terminal and configured to analyze the received access code, and a locking member disposed on a rear side of the housing, the locking member selectively shiftable between a locked position and an unlocked position;

a battery case operatively connected to the housing and configured to contain at least one battery for powering the electronic locking device; and a hinge operatively coupling the housing and the battery case, the hinge being configured to permit the battery case and at least one battery to shift relative to the housing between a first position and a second position, the hinge configured to releasably secure the battery case in at least the first position.

8. The electronic locking device of claim 7, wherein the locking member is a bolt, a cam, or a latch.

9. The electronic locking device of claim 7, wherein the housing is mounted to a panel or door of an item of furniture.

10. The electronic locking device of claim 9, further comprising a lock plate fixedly connected to the housing, wherein the lock plate is mounted to a surface of the panel or door.

11. The electronic locking device of claim 9, wherein the panel is a top rail in a file cabinet above a drawer.

12. An electronic locking device, comprising:

a housing having a terminal for the receipt of an access code, a microcontroller in communication with the terminal and configured to analyze the received access code, and a locking member disposed on a rear side of the housing, the locking member selectively shiftable between a locked position and an unlocked position;

a battery case operatively connected to the housing and configured to contain at least one battery for powering the electronic locking device;

a hinge operatively coupling the housing and the battery case, the hinge being configured to permit the battery case to shift relative to the housing between a first position and a second position, the hinge configured to releasably secure the battery case in at least the first position;

a lock plate fixedly connected to the housing, and a battery plate fixedly connected to the battery case, wherein the battery plate is releasably secured in the first position by at least a portion of the lock plate contacting at least a portion of the battery plate.

13. An electronic locking device, comprising:

a housing having a terminal for the receipt of an access code, a microcontroller in communication with the terminal and configured to analyze the received access code, and a locking member disposed on a rear side of the housing, the locking member selectively shiftable between a locked position and an unlocked position;

a battery case operatively connected to the housing and configured to contain at least one battery for powering the electronic locking device; and a hinge operatively coupling the housing and the battery case, the hinge being configured to permit the battery case to shift relative to the housing between a first position and a second position, the hinge configured to releasably secure the battery case in at least the first position;

the hinge comprising a pin defining an axis about which the housing and battery case pivot; and the battery case being slidable in a direction parallel to the axis to release the battery plate from the first position.

14. An electronic locking device, comprising:

a housing having a terminal for the receipt of an access code, a microcontroller in communication with the terminal and configured to analyze the received access code, and a locking member disposed on a rear side of the housing, the locking member selectively shiftable between a locked position and an unlocked position;

a battery case operatively connected to the housing and configured to contain at least one battery for powering the electronic locking device; and a hinge operatively coupling the housing and the battery case, the hinge being configured to permit the battery case to shift relative to the housing between a first position and a second position, the hinge configured to releasably secure the battery case in at least the first position; and a tab and a recess, the tab configured to seat in the recess to releasably secure the battery case.

15. The electronic locking device of claim 12, wherein the lock plate and battery plate are integral with the hinge.

16. A method of replacing batteries in an electronic locking device, comprising:

pivoting a battery case containing at least one battery relative to a housing from a storage position to an access position, the housing being mounted to a panel of an article of furniture and having a terminal for the receipt of an access code, a microcontroller in communication with the terminal and configured to determine if the received access code is a predetermined access code, the housing further including a locking member disposed on a rear side of the housing, the locking member selectively shiftable between a locked position and an unlocked position, the terminal being addressable from outside the article of furniture, the battery case being disposed within the article of furniture;

securing the battery case in the access position; and opening the battery case containing the at least one battery for powering the electronic locking device.

17. The method of claim 16, the electronic locking device further comprising a lock plate fixedly coupled to the housing and a battery plate fixedly coupled to the battery case, the step of securing the battery case in the access position further comprising contacting at least a portion of the lock plate with at least a portion of the battery plate.

* * * * *